United States Patent [19]

Henderson

[11] Patent Number: 4,676,692

[45] Date of Patent: Jun. 30, 1987

[54] UNDERWATER GROWTH INHIBITION

[76] Inventor: Thomas Henderson, "Clifden", Pollurrian Front, Mullion, Near Helston Cornwall, England

[21] Appl. No.: 756,151

[22] PCT Filed: Oct. 24, 1984

[86] PCT No.: PCT/GB84/00361

§ 371 Date: Jun. 28, 1985

§ 102(e) Date: Jun. 28, 1985

[87] PCT Pub. No.: WO85/01971

PCT Pub. Date: May 9, 1985

[30] Foreign Application Priority Data

Oct. 31, 1983 [GB] United Kingdom ..... 8328986

[51] Int. Cl.[4] ..... E02D 5/60; E02D 31/00

[52] U.S. Cl. ..... 405/211; 405/216

[58] Field of Search ..... 405/24, 61, 195, 211, 405/212, 216; 134/42

[56] References Cited

U.S. PATENT DOCUMENTS

| | | | |
|---|---|---|---|
| 1,008,669 | 11/1911 | Nixon | 405/211 |
| 1,036,907 | 8/1912 | Reynolds | 405/211 |
| 1,134,881 | 4/1915 | Lockwood | 405/211 |
| 1,266,050 | 5/1918 | Reynolds | 405/211 |
| 1,279,732 | 9/1918 | Lockwood | 405/211 |
| 3,352,118 | 11/1967 | Burkhardt | 405/211 |
| 4,230,423 | 10/1980 | Oshima et al. | 405/211 |
| 4,478,533 | 10/1984 | Garrett | 405/211 X |

FOREIGN PATENT DOCUMENTS

| | | |
|---|---|---|
| WO80/00262 | 2/1980 | PCT Int'l Appl. . |
| 2078546 | 1/1982 | United Kingdom . |

*Primary Examiner*—Cornelius J. Husar
*Assistant Examiner*—Nancy J. Stodola
*Attorney, Agent, or Firm*—Panitch Schwarze Jacobs & Nadel

[57] ABSTRACT

To inhibit marine growth on a submerged framework, one or more collars are placed loosely around each member of the framework, the collars having outwardly projecting vanes so that ambient water movement causes movement around or along the member. The vanes (5; 25; 45; 55; 65) are preferably hinged to the collar for limited pivotation and may be twisted or provided with extension portions to ensure axial movement.

20 Claims, 10 Drawing Figures

UNDERWATER GROWTH INHIBITION

The invention relates to the inhibition of underwater growth.

Objects which are submerged in the sea for considerable periods are subject to marine growth. In the case of the support structure of oil and gas rigs, substantial marine growth is very disadvantageous, because its weight places extra stresses on the structure, and because it alters the original design profile so changing the design stress loading characteristics. The marine growth must therefore be removed from time to time, but removal constitutes a time consuming and therefore costly operation.

The present invention is concerned with the inhibition of underwater growth in a simple and convenient manner.

In accordance with the invention, there is provided a device arranged to extend around an underwater body, the device being responsive to ambient water movement to move relative to the body so as to remove marine growth therefrom.

The invention also provides a method of removing underwater growth from an underwater body in which the body is surrounded by a device responsive to water movement to move over the surface of the body to thereby brush away any underwater growth that has settled on the surface. The body will typically be an elongate body, for example a circular cylindrical pipe, which will be encircled by the device of the invention and cleaned of underwater growth by axial and/or rotational movement of the device.

The device can comprise a ring or collar having external vanes or other propulsion configurations responsive to ambient water movements to cause movement of the ring or collar around and/or along the body about which it is placed. The propulsion vanes or fingers are preferably hinged to the collar, advantageously so as to lie substantially tangentially when located on one side of the body, thus presenting little drag, and so as to project outwardly on the other side, thus presenting a greater drag. When projecting outwardly, the vanes preferably extend subatntially radially and this position can be defined by a stop acting between each vane and the ring or collar. Axial movement of the device is obtained by providing the vanes with a twisted configuration or with a laterally extending tab or finger.

The ring or hoop may also be configured on its inner side so as to promote the displacement of growth from the surface of the surrounded body. The minimise the possibility of jamming of the device on the object, the inner surface of the ring or collar can be convex, for example, semi-circular or otherwise outwardly curved in radial cross-section.

The device can conveniently be manufactured of a suitable plastics material in the form of an elongate strip with spaced configurations by means of which the ends of an approrpriate length can be connected together to form a ring. The propulsion means of the device can be constituted by integral portions of such elongate strip material, the portions being partially separated from the adjacent material and hinged outwardly from it.

The device of the invention can conveniently be made in two materials of different specific gravities, so as to float and sink in water respectively. The propulsion configurations can be shaped and/or arranged so that the floating device tends to travel in a downward direction in response to the action of ambient tides and current, whilst the sinking device tends to travel upwardly. During still water conditions, the devices float and sink to end positions, normally defined by connections of the elongate body about which they extend to other elements of the structure, but on the resumption of water movement, they move towards each other, and brush off small and immature growth from the element as they do so. The provision of two such devices on each body or length of body ensures that, the cleaning effect is maintained by one should the other become detached.

The invention will be more readily understood from the following illustrative description and the accompanying drawing, in which.

Figure 1:
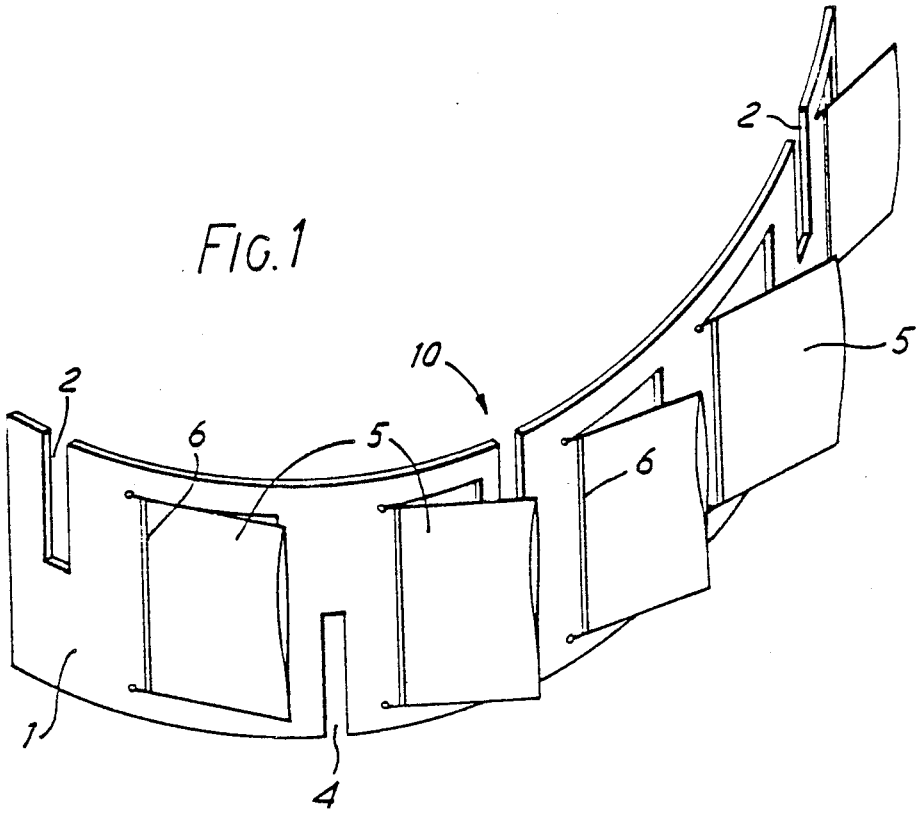
FIG. 1 is a perspective view of material ready to be formed into a first device embodying the invention.

The material for forming a device in accordance with the invention shown in FIG. 1 comprises an elongate strip 1 of plastics material, preferably a fairly hard but resilient material, such as polypropylene. The body of the strip is of thin rectangular section and is provided with spaced rectangular slots 2 opening in from one side edge and spaced like slots opening in from the other edge at positions between the slots 2.

By cutting off a length of the strip 1 so that there is a slot 2 at one end of the length, for example as shown at the left hand end of FIG. 1, and a slot 4 at the other, a substantially circular cylindrical ring can readily be formed by connecting the ends of the length together by means of the slots. The width of the slots 2, 4 corresponds to the thickness of the body of the strip, so that the two ends are frictionally held together after assembly.

Between each adjacent pair of slots 2, 4, the strip 1 is provided with a propulsion vane or blade 5 of generally rectangular shape, with its longer sides extending transverse to the strip material. Along one of these longer sides, the vane 5 is integrally connected with the strip material by a hinge portion 6 formed to bias the vane to a predetermined angular relationship with the body of the strip material.

To form a device 10 of the invention, the strip 1 is cut to an appropriate length for connection into a ring by means of the slots 2, 4 as described, with the vanes 5 biassed outwardly.

The device 10 can be put in place around a horizontally extending elongate element prior to submergence of the structure of which the element forms in part, or in situ by divers, preferably after a cleaning operation to remove existing marine growth where the structure has been submerged long enough for this to have become established. The device 10 then turns on the submerged element in response to water movement, the vanes 5 being urged towards a tangential position when on one side of the element and towards a radial position, against the bias of the hinge portion 6 on the other.

Figure 2:
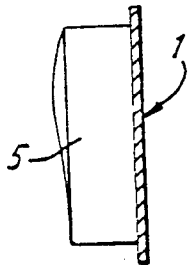
FIG. 2 is a view of a detail of the material of FIG. 1.

To ensure that even water movement in a direction at right angles or parallel to the axis of the elongate element causes movement of the device 10 along that axis, as well as rotational movement, the vanes 5 are profiled, as shown in FIGS. 1 and 2, so as to have an asymmetrical cross-section. The axial and rotational movements of the device 10 can of course be achieved in a variety of ways, for example, as by arranging the hinges 6 at an inclination to the length of the strip 1 instead of at right angles to it.

The second illustrated device 20 according to the invention, shown in FIG. 3, again comprises a ring or collar 21 which may be formed from strip material in the same way as was the device 10. The device 20 has preferably about eight vanes 25 spaced equally around the collar 21, each vane being freely hinged to the collar by a flexible hinge connection member 26. The inner end of each vane 25 has a portion 27 turned substantially at right angles to the plane of the vane, to function as a stop element.

Figure 3:
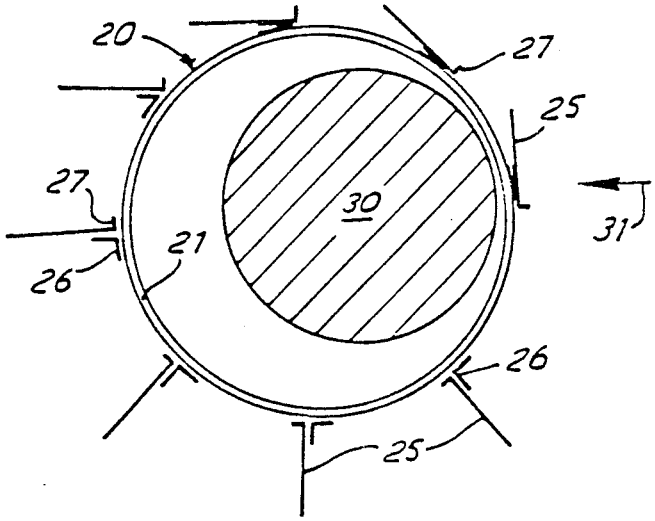
FIG. 3 is a schematic plan view of a second device embodying the invention in place around an elongate body.

When placed around a horizontally extending submerged elongate element 30 of circular cross-section, and exposed to water movement in the direction indicated by the arrow 31, rotation of the device 20 around the element ensues, because of the operation of the vanes 25, as with the vanes 5 of the device 10. Thus as shown in FIG. 3, the vanes 25 on the upper side of the element 30 are caused by the water flow to move to a substantially tangential position, with the stop portion 27 extending generally radially. As they reach the downstream side of the element 30, the vanes 25 begin to turn outwardly on the hinge members 26 until on the lower side of the element 30 they extend substantially radially of the collar 21. The vanes 25 cannot pivot beyond this radial position, because of the engagement between the stop portion 27 and the outer surface of the collar 21.

Figure 4:
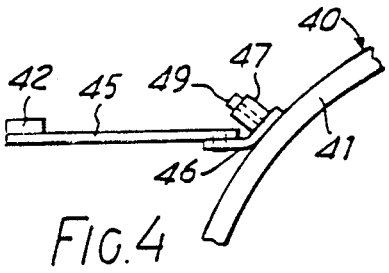
FIGS. 4 and 5 are respectively partial axial and side views of a third device embodying the invention.
Figure 5:
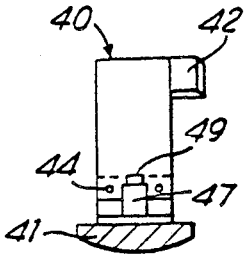

In the third device 40 according to the invention partially shown in FIGS. 4 and 5, a collar 41 has rigid vanes 45, preferably eight in number, pivotally connected to it by flexible hinge members 46. Each hinge member 46 has a portion clamped to the outer surface of the collar 40 by a stop member 47. A bolt 49 extends through aligned apertures in the stop member 47 and the hinge member portion into a tapped hole in the collar. The relatively rigid vane 45 is secured to a free end portion of the hinge member 46 as by rivets 44. The vane 45 may be rectangular, but is preferably provided with at least one offset or lateral extension portion 42, which may be integrally formed with the rest of the vane, so that the device experiences not only a rotational movement but also an axial movement, whatever the direction of the flow impinging on the vanes. The extension portion 42 can be located at the outer end of the vane 45 as shown or elsewhere, for example, at the inner end of the vane, when the portion can function also as a stop element.

Figure 6:
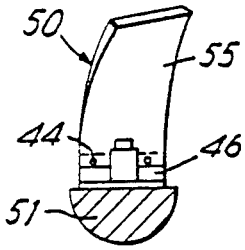
FIG. 6 is a partial side view of a fourth device embodying the invention.

FIG. 6 shows a fourth device 50 according to the invention, which generally resembles that shown in FIGS. 4 and 5, but in which each vane 55 is hinged to a ring or collar 51 and is formed with a twist along its length. The twisted vane configuration functions, in place of the lateral extension portion 42 of the vane 45, to ensure that the device 50 experiences axial movement.

As appears from FIG. 5, the collar 41 has a rounded, convex, inner surface, to minimise any tendency of the device 40 to jam on the underwater element 30. In the device 50, shown in FIG. 6, jamming is prevented similarly by the semicircular cross-section of the collar 51.

Figure 7:
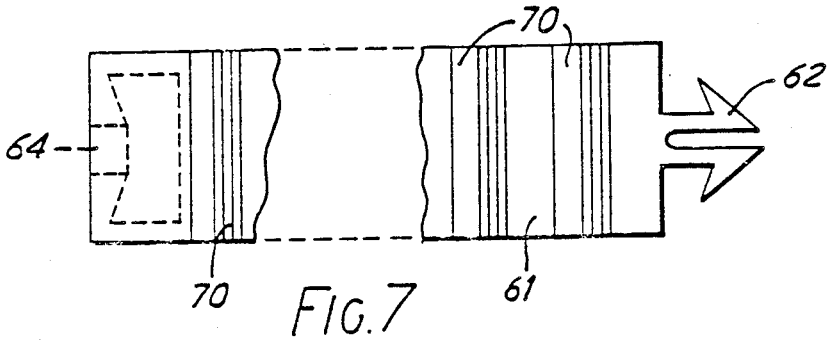
FIG. 7 is a partial plan view of a fifth device embodying the invention.
Figure 9:
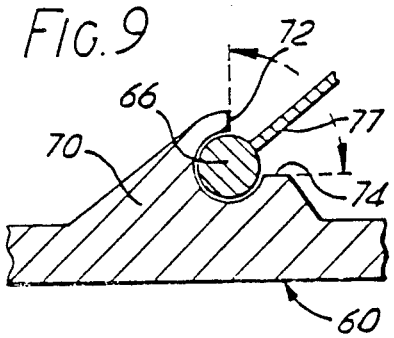
FIG. 9 is a partial cross-sectional view of the device of FIGS. 7 and 8.
Figure 8:
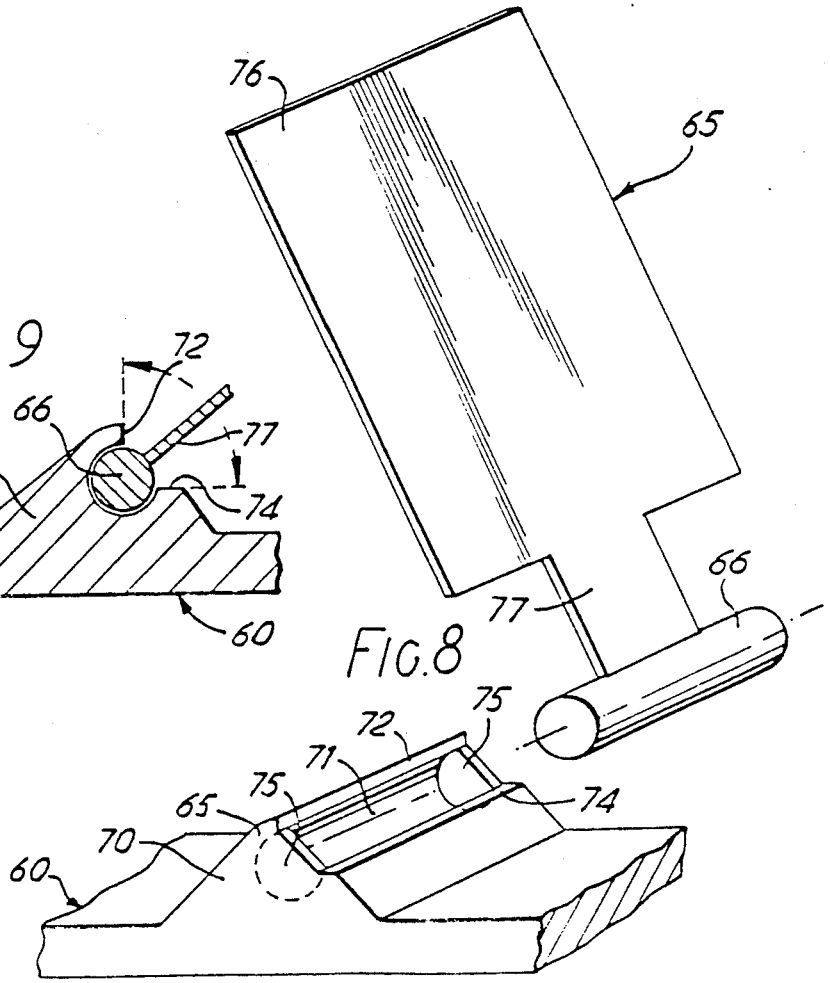
FIG. 8 is a partial exploded perspective view of the device of FIG. 7.

A fifth device 60 according to the invention, shown in FIGS. 7, 8 and 9, has a collar 61, which is shown in all three Figures as a flat strip, that is, in the condition in which it is manufactured. The strip can be moulded from a suitable plastics material with uniform thickness and with interlocking formations by which the ends are joined together, preferably so as not to be thereafter separable, to form the collar of the device. Such end formations are shown in FIG. 7 as a divided arrowhead 62 at one end of the strip and, at the other end, a tunnel 64 through which the arrowhead can be pushed until the barbs of the arrowhead expand into a wider cavity beyond the far end of the tunnel, to securely connect the ends together.

The device 60 includes a plurality of rigid vane members 65, preferably eight in number, each having a hinge portion 66 received in an appropriately shaped hinge recess integrally formed in the collar, as will be seen from FIGS. 8 and 9.

The hinge recesses are provided in transverse ridges 70 of approximately triangular formation, equally spaced around the outer surface of the collar. Each recess is formed as a transverse part-cylindrical pocket 71 along the upper part of one side face of each ridge, the pocket edges being defined by a first abutment surface 72 extending in a generally radial plane and a second abutment surface 74 extending generally tangentially. The pocket 71 is limited at its end by side wall portions 75.

Each vane member 65 comprises a rectangular vane portion 76 integrally connected with the rod-like hinge portion 66 by a neck portion 77 extending from one of the vane portion shorter edges. The hinge portion 66 makes a snap fit in the pocket 71 and when so received, the vane member is free to pivot on the hinge portion between end positions defined by engagement of the abutment 72, 74 by the neck portion 77, in which positions the vane portion 76 extends generally radially of the collar and generally tangentially, respectively.

The device 60 can be readily modified if required, for example, so that the range of movement of the angular movement is greater or smaller than as indicated by the arrow 80 in FIG. 9. The shape of the vane portion 76 can be other than a planer rectangular shape, for example, the vane portion can be twisted as shown in FIG. 6 and/or provided with one or more offset portions providing rotational movement and/or functioning as stop elements, similarly to the offset portion 42 of FIG. 5. The strip forming the collar can have a cross-section similar to that shown in FIG. 5 or FIG. 6 and its ends can be connected by other means than the interlocking formations shown.

However a device embodying the invention is constructed and configured, it preferably has eight vanes evenly spaced around and the ratio of the collar internal diameter to external diameter of the underwater element or body which it surrounds is preferably in the range of 1.1 to 1.3. The ratio of the length of the vanes to the diameter of the underwater body is preferably in excess of 0.4 and the vanes are preferably arranged to pivot outwardly to a position in which they make an angle in the range of 60° to 90° to the tangent at the position of connection to the collar.

Figure 10:
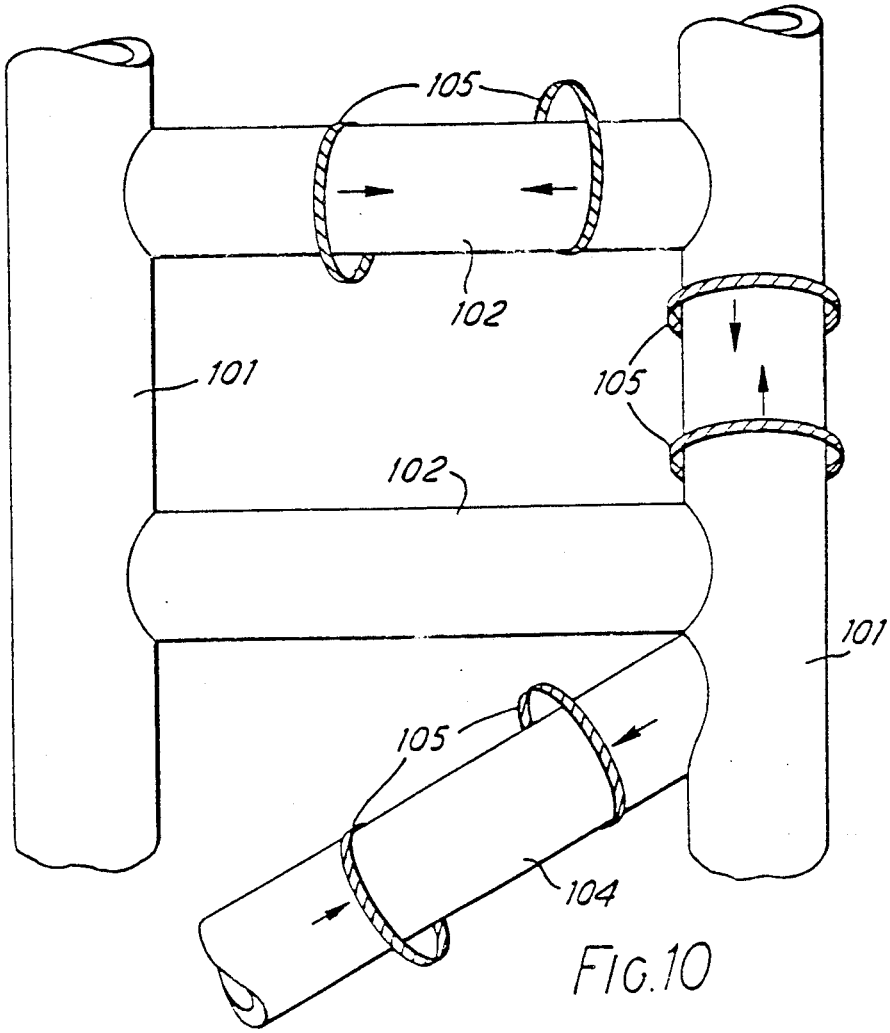
FIG. 10 shows devices embodying the invention, on a smaller scale, in place on elongate elements of an undersea support structure for example of an oil or gas rig.

FIG. 10 shows part of an undersea support structure typical of the structures of which devices of the present invention can advantageously be applied. The illustrated structure includes two generally vertical legs 101 connected together by generally horizonal struts 102 and an inclined strut 104.

To provide adequate protection against marine growth on the horizontal and inclined struts 102 and 104, these struts can each be fitted with at least one device 105 embodying the invention for example the devices 20 illustrated in FIG. 3, the device 40 of FIGS. 4 and 5 without the extension portions 42, or the device 60 of FIGS. 7–9. The vanes of the devices provide an effective means of rotation and performance can be improved by making the devices at least approximately neutrally buoyant. As for axial movement, the devices move along the struts even when small angles of the flow direction is at a quite small angle, for example 10° from the normal to the strut axis. The varying directions of tidal currents and superimposed wave action will normally provide the desired axial movement along the horizontal struts 102, and, for the inclined strut 104, a component of current velocity either up or down the strut will cause corresponding motion of the device if this is neutrally buoyant.

For the vertical legs 101, the devices 105 embodying the invention requires to have vanes given an angle of twist, or pitch, as shown in FIG. 6 or extension portions as shown in FIGS. 5 and 6.

At least one growth inhibiting device 105 in accordance with the invention is provided on each length of each leg or strut along which the device is able to move, that is, on ech length between connections to other elements of the structure. Although, the beneficial effects of the invention can be obtained by a single device on each such length, it is prefered as shown to provide two devices. Should one of the devices become inadvertently detached and float away, the other can traverse the entire length previously shared with the detached device, so that an effective cleaning operation is still achieved.

I claim:

1. A device for removal or inhibition of underwater growth on an elongate underwater body, said device comprising:

a collar adapted to extend loosely around said elongate underwater body;

a plurality of rigid vane elements;

a plurality of hinge means, each hinge means hingedly mounting a respective one of said vane elements externally of said collar for pivoting relative thereto, said vane elements being configured so as to cause rotational movement of said device in response to ambient water movement.

2. The device of claim 1 further comprising stop means limiting pivoting of each of said vane elements outwardly from said collar.

3. The device of claim 2 wherein said stop means limit said outward pivoting to a substantially radially directed position of said vane elements.

4. The device of claim 1 further comprising means limiting pivoting of each of said vane elements between a position in which said vane element is substantially aligned with a tangent to said collar at the associated one of said hinge means and a position in which said vane element makes an angle in the range of 60 to 90 degrees to said tangent.

5. The device of claim 1 wherein said hinge means permit pivoting of said vane element about respective axes substantially parallel to the axis of said collar.

6. The device of claim 1 wherein said vane elements are substantially uniformly spaced around said collar.

7. The device of claim 1 wherein said collar comprises a length of strip material having formations at the ends thereof, which formations are adapted to interengage to form said collar.

8. The device of claim 1 wherein said collar has an inner surfce which is convex in radial cross-section.

9. The device of claim 4 wherein said vane elements are each shaped so as to impart axial as well as rotational movement to said collar.

10. The device of claim 9 wherein each of said vane elements has a twisted configuration, being twisted about an axis extending away from said hinge means.

11. The device of claim 10 wherein said rigid vane elements each comprises a vane portion and a lateral extension portion.

12. The device of claim 1 wherein each of said hinge means comprises a flexible hinge member and further comprising a plurality of bolts, each bolt extending through a respective one of said hinge members into said collar, and means securing each of said vane elements to a free end of a respective one of said hinge members.

13. In combination, an elongate underwater member of generally circular cross-section and at least one device for removal or inhibition of underwater growth on the member, said at least one device comprising a generally circular hoop surrounding said member, and vane elements hinged to said hoop for pivoting relative thereto to extend outwardly therefrom, said vane elements being shaped to cause movement of said device around and along said member in response to movement of the water in which said member is submerged.

14. The combination of claim 13 wherein the ratio of the internal diameter of said hoop to the external diameter of said body is in the range of 1.1 to 1.3.

15. The combination of claim 13 wherein said member extends generally upright and wherein two of said devices surround said member, one of said devices being adapted to float and the other of said devices being adapted to sink.

16. The combination of claim 15 wherein said one of said devices has the vane elements thereof adapted to cause upward movement of said device and wherein the second of said devices has the vane elements thereof adapted to cause downward movement of said device.

17. The combination of claim 13 wherein the ratio of the length of said vane elements to the diameter of said underwater member is in excess of 0.4.

18. In combination, an elongate underwater member of generally circular cross-section and at least one device for removal or inhibition of underwater growth on the member, said at least one device combination a hoop extending around said member, and vane elements, pivotally attached to and extending outwardly from said hoop, said vane elements being shaped so that movement of the water in which said member is submerged causes movement of said device axially of said member.

19. The combination of claim 18 wherein said device has at least approximately neutral buoyancy.

20. The combination of claim 18 wherein said vane elements are shaped to cause rotational movement of said device around said member in response to movement of the water in which said member is submerged.

* * * * *